US005658721A

United States Patent [19]

Griggs et al.

[11] Patent Number: 5,658,721

[45] Date of Patent: Aug. 19, 1997

[54] STABILIZED VINYL SULFONE HARDENING COMPOSITIONS USEFUL IN PHOTOGRAPHIC MANUFACTURING

[75] Inventors: Mary Jane Griggs, Webster; Lewis Robert Hamilton, Rochester; Peter Anthony Marr, Webster; Philip Raymond Martell, Rochester, all of N.Y.

[73] Assignee: Eastman Kodak Company, Rochester, N.Y.

[21] Appl. No.: 576,144

[22] Filed: Dec. 21, 1995

[51] Int. Cl.[6] ..... G03C 1/30

[52] U.S. Cl. ..... 430/622; 430/621; 430/640; 430/642; 252/182.17; 252/402

[58] Field of Search ..... 430/622, 607, 430/621, 640, 631, 642; 252/182.17, 402, 182.29, 182.28; 527/203, 207; 508/19

[56] References Cited

U.S. PATENT DOCUMENTS 3,490,911 1/1970 Burness et al. .
3,642,486 2/1972 Burness et al. .
3,841,872 10/1974 Burness et al. .
4,104,302 8/1978 Smith et al. .
4,171,976 10/1979 Burness et al. .
4,670,377 6/1987 Miyoshi et al. .
4,874,687 10/1989 Itabashi .
5,514,535 5/1996 Hamilton et al. ..... 430/622

*Primary Examiner*—Thorl Chea
*Attorney, Agent, or Firm*—Carl F. Ruoff; Alfred P. Lorenzo

[57] ABSTRACT

Hydrophilic colloids, such as gelatin, which are employed in the manufacture of photographic elements are commonly treated with a hardening composition, among the most useful of which are hardening compositions containing vinyl sulfone hardening agents such as bis(vinylsulfonyl)methane. In accordance with this invention, citric acid or salts of citric acid are utilized as an effective inhibitor of homopolymerization in such hardening compositions.

22 Claims, No Drawings

STABILIZED VINYL SULFONE HARDENING COMPOSITIONS USEFUL IN PHOTOGRAPHIC MANUFACTURING

CROSS-REFERENCE TO RELATED APPLICATIONS

Copending commonly-assigned U.S. patent application Ser. No. 438,634, filed May 10, 1995, "Stabilized Vinyl Sulfone Hardening Compositions Useful In Photographic Manufacturing" by Lewis R. Hamilton, Peter A. Marr, Philip R. Martell and Kristine F. Ohman, describes hardening compositions comprising a vinyl sulfone hardening agent and a sufficient amount of a sulfate to inhibit homopolymerization of the vinyl sulfone hardening agent.

FIELD OF THE INVENTION

This invention relates in general to the hardening of hydrophilic colloids utilized in photographic elements and in particular to the hardening of such colloids using a hardening composition containing, as a hardening agent, a compound comprising two or more vinyl sulfonyl groups. More specifically, this invention relates to improved hardening compositions containing the aforesaid hardening agent and a stabilizing agent which inhibits homopolymerization of such hardening agent.

BACKGROUND OF THE INVENTION

In the photographic arts, hydrophilic colloids, typically refined gelatin, have been used in photographic elements to form layers, such as radiation-sensitive layers (e.g., silver halide emulsion layers), interlayers, subbing layers and overcoat layers. Various addenda are conventionally incorporated in the layers, including addenda to alter the properties of the hydrophilic colloids present therein. It has been recognized previously in the art that without special modifiers, hydrophilic colloids such as gelatin are easily abraded and ingest large quantities of water when brought into contact with aqueous solutions, thereby causing an undesirable amount of swelling. Also, unmodified colloid coatings tend to melt at relatively low temperatures, thereby limiting their temperature range of utility. To obviate these deficiencies, certain addenda generically designated as "hardeners" are incorporated into hydrophilic colloids intended to be used in forming photographic element layers. Both inorganic and organic hardeners are known. A summary of hardeners is presented in *Research Disclosure*, Item 36544, September, 1994. The terms "forehardened" and "forehardener" are employed when the hardener is associated with hydrophilic colloid in the course of manufacturing a photographic element. The terms "prehardened" and "prehardener" are employed when the hardener is associated with a hydrophilic colloid layer of a photographic element in a processing solution preceding the developer bath for the element.

Among hardeners of the active olefin type, a preferred class of hardeners particularly useful as forehardeners are compounds comprising two or more vinyl sulfonyl groups. These compounds are hereinafter referred to as "vinyl sulfones." Compounds of this type are described in numerous patents including, for example, U.S. Pat. Nos. 3,490,911, 3,642,486, 3,841,872 and 4,171,976. Vinyl sulfone hardeners are believed to be effective as hardeners as a result of their ability to crosslink polymers making up the colloid. One disadvantage that has been observed in using vinyl sulfone hardeners is that these hardeners, particularly the more active ones, such as bis(vinylsulfonyl)methane (BVSM), will homopolymerize. Homopolymerization can occur before the hardeners are associated with the hydrophilic colloid and it can occur as a competing reaction after association. The tendency of the hardeners to homopolymerize is disadvantageous in requiring careful selection of hardener preparation and handling conditions and in causing hardener to become unavailable for the desired crosslinking reaction with the hydrophilic colloid. The consequences of such homopolymerization include the inability to maintain the desired concentration of hardener in the hardening solution and the plugging of delivery lines and other equipment with the polymer that is formed, thereby necessitating frequent downtime for cleaning and maintenance.

The problem of homopolymerization of vinyl sulfones used in compositions for hardening of photographic gelatin has long been recognized in the photographic art. Thus, for example, D. M. Burness et al in U.S. Pat. No. 4,171,976, issued Oct. 23, 1979, describes this problem and discloses the use of certain inhibitors such as 3,5-dinitrobenzoic acid to prevent or minimize homopolymerization of bis (vinylsulfonyl)alkane hardeners. Similarly, Burness et al U.S. Pat. No. 3,841,872, issued Oct. 15, 1974, utilizes hydroquinone as a stabilizer in the preparation of bis (vinylsulfonyl)alkane hardeners.

In the preparation and handling of hardening solutions containing a vinyl sulfone hardening agent, it is advantageous to utilize a conductivity marker, i.e., a material that is added to the relatively non-conductive hardening solution to assist with identification by rendering it feasible to monitor electrical conductivity and thereby ensure delivery of the correct hardener solution to the coating station. Thus, for example, a desirable conductivity for a BVSM solution is 2.6 to 3.0 mhos/cm. The conductivity marker should not adversely affect the quality or handling of the hardening solution.

A compound that has been commonly used as a conductivity marker in photographic hardening compositions is potassium nitrate. However, the use of potassium nitrate is disadvantageous in that it contributes to and accelerates the formation of homopolymer in vinyl sulfone hardening solutions when ferric ion is present in levels of only a few parts per million. Such levels of ferric ion are commonly encountered, with a major source being the iron oxides formed on the surfaces of iron pipes and other equipment used to convey the hardening solution and a minor source being iron present in the vinyl sulfone monomer from its synthesis. Thus, when using potassium nitrate as a conductivity marker, it is difficult to meet required quality specifications and the homopolymerization which occurs results in clogged delivery lines and frequent interruptions in the photographic manufacturing process.

The aforesaid U.S. patent application Ser. No. 438,634 describes the use of sulfates, such as ammonium sulfate, alkali metal sulfates and alkaline earth metal sulfates, as stabilizers for vinyl sulfones. The sulfates are highly effective in inhibiting homopolymerization in the presence of ferric ion and are also useful as a conductivity marker.

It is toward the objective of providing a further class of highly useful stabilizing agents that can, if desired, be employed in conjunction with the sulfates that this invention is directed.

SUMMARY OF THE INVENTION

In accordance with this invention, it has been discovered that citric acid and salts thereof are effective inhibitors of homopolymerization in vinyl sulfone hardening compositions. Useful salts for this purpose include ammonium salts of citric acid, alkali metal salts of citric acid such as lithium, sodium or potassium salts, and alkaline earth metal salts of citric acid such as magnesium salts. The use of alkali metal salts is preferred and the use of the trisodium salt of citric acid is particularly preferred.

For convenience, the term "citric stabilizer" is used hereinafter to refer to citric acid or an ammonium, alkali metal or alkaline earth metal salt thereof.

In the practice of this invention, vinyl sulfone hardeners are inhibited against homopolymerization without interfering with their utility as hardeners, i.e., hydrophilic colloid crosslinking agents, by combining with the hardener a homopolymerization-inhibiting amount of a citric stabilizer.

In one embodiment, this invention is directed to a photographic hardener composition comprising a vinyl sulfone hardener and an amount sufficient to inhibit homopolymerization of the hardener of a citric stabilizer.

In another embodiment, this invention is directed to an aqueous coating composition useful as a layer of a photographic element comprising a hydrophilic colloid at least partially forehardened with a vinyl sulfone hardener. The composition comprises a citric stabilizer in an amount sufficient to inhibit homopolymerization of the hardener.

In still another embodiment, this invention is directed to a process of hardening an aqueous coating composition useful as a layer of a photographic element comprising adding a vinyl sulfone hardener to a hydrophilic colloid. The improvement comprises inhibiting homopolymerization of the hardener with a citric stabilizer.

In yet another embodiment, this invention is directed to a process of hardening a hydrophilic colloid-containing layer of a photographic element by adding a vinyl sulfone hardener to a coating composition containing the hydrophilic colloid and coating the composition onto a photographic support. The improvement comprises inhibiting homopolymerization of the hardener with a citric stabilizer.

In an additional embodiment, this invention is directed to a photographic element comprising a support and, coated on the support, one or more layers, at least one of which is radiation-sensitive, containing a hydrophilic colloid at least partially forehardened with a vinyl sulfone hardener. The improvement comprises a citric stabilizer present with the hardener in an amount sufficient to inhibit homopolymerization of the hardener.

In yet another embodiment, this invention is directed to a photographic hardener composition comprising a vinyl sulfone hardener, an amount sufficient to inhibit homopolymerization of the hardener of a citric stabilizer, and a sulfate in an amount sufficient to act as a conductivity marker. Useful sulfates for employment as conductivity markers include ammonium sulfate, alkali metal sulfates such as lithium, sodium or potassium sulfate, and alkaline earth metal sulfates such as magnesium sulfate. The use of alkali metal sulfates is preferred and the use of sodium sulfate is particularly preferred.

In the foregoing embodiments, the vinyl sulfone hardener is preferably of the formula:

$$(H_2C{=}CH{-}SO_2)_n{-}Z$$

wherein n is an integer with a value of 2 to 6 and Z is an organic linking group with a valence equal to n.

DETAILED DESCRIPTION OF THE INVENTION

Any hydrophilic colloid which can be hardened by a vinyl sulfone hardening agent can be employed in the practice of this invention.

The use of film-forming hydrophilic colloids in photographic elements, including photographic films and photographic papers, is very well known. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, the element containing in at least one layer thereof a hydrophilic colloid that has been hardened with a hardening composition containing a vinyl sulfone hardening agent and a stabilizing amount of a citric stabilizer that inhibits homopolymerization of the vinyl sulfone hardening agent.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 36544, September, 1994, and the references listed therein.

The photographic silver halide emulsions utilized in this invention can contain other addenda conventional in the photographic art. Useful addenda are described, for example, in *Research Disclosure*, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Any of the vinyl sulfone hardeners known to the art can be utilized in the practice of this invention. As hereinabove described, a preferred class of vinyl sulfone hardeners for use in this invention are compounds of the formula:

$$(H_2C{=}CH{-}OS_2)_n{-}Z$$

wherein n is an integer with a value of 2 to 6 and Z is an organic linking group with a valence equal to n. Suitable examples of the organic linking group represented by Z include alkyl, alkylene, aryl, arylene, aralkyl and alkaryl groups. As a further example Z can be a heteroatom such as a nitrogen atom or an ether oxygen atom.

In the above formula Z is preferably

—A—

—O—A—, or

—D— where A is an alkylene group containing 1 to 8 carbon atoms which may be unsubstituted or substituted and the alkylene chain may be interrupted by one or more hetero atoms or organic groups, or an arylene group, which may be substituted or unsubstituted, and D is a trivalent alkylene group, a trivalent arylene group which may be substituted with one or more additional $CH_2{=}CH{-}SO_2{-}$ groups, a trivalent cyclic alkylene group which may be substituted with one or more $CH_2{=}CH{-}SO_2{-}$ groups, or a trivalent heterocyclic group which may be substituted with one or more $CH_2{=}CH{-}SO_2{-}$ groups. Preferred substituents for A include —OH, phenyl, aralkyl, such as phenethyl, or $CH_2{=}CH{-}SO_2{-}$ groups. The aryl moiety of the aralkyl group may be sulfonated. The alkylene group may be interrupted by one or more of the following: oxygen atoms, arylene groups, cycloalkyl groups, —NHCONH—, or —N—R, where R is an alkyl group containing 1 to 8 carbon atoms.

A particularly preferred class of vinyl sulfone hardeners for use in this invention are bis(vinylsulfonyl)alkane hardeners of the formula:

$$CH_2{=}CH{-}SO_2{-}(CH_2)_x{-}SO_2{-}CH{=}CH_2$$

where x is an integer with a value of from 1 to 3.

A preferred vinyl sulfone hardener for use in this invention is bis(vinylsulfonyl)methane (BVSM) which has the formula:

$$CH_2{=}CH{-}SO_2{-}CH_2{-}SO_2{-}CH{=}CH_2$$

Another preferred vinyl sulfone hardener for use in this invention is bis(vinylsulfonylmethyl)ether (BVSME) which has the formula:

$$CH_2{=}CH{-}SO_2{-}CH_2{-}O{-}CH_2{-}SO_2{-}CH{=}CH_2$$

Specific examples of other vinyl sulfone hardening agents that are useful in this invention include the following:

$$CH_2{=}CHSO_2CH_2CH_2SO_2CH{=}CH_2$$

$$CH_2{=}CHSO_2(CH_2)_5SO_2CH{=}CH_2$$

$$CH_2{=}CHSO_2OCH_2OSO_2CH{=}CH_2$$

$$CH_2{=}CHSO_2CH_2CH_2OCH_2CH_2NHCONHCH_2CH_2{-}OCH_2CH_2SO_2CH{=}CH_2$$

$$CH_2{=}CHSO_2CH_2CH_2OCH_2CH_2OCH_2CH_2SO_2CH{=}CH_2$$

$$CH_2{=}CHSO_2CH_2CH_2OCH_2CH_2CH_2CH_2OCH_2CH_2SO_2CH{=}CH_2$$

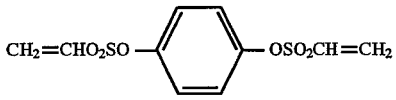

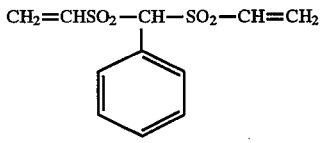

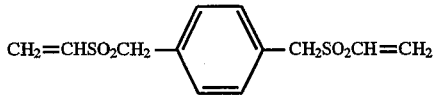

$$CH_2{=}CHSO_2CH_2\underset{\underset{OH}{|}}{C}HCH_2SO_2CH{=}CH_2$$

$$CH_2{=}CHSO_2CH_2\underset{\underset{OH}{|}}{C}HCH_2\underset{\underset{OH}{|}}{C}HCH_2SO_2CH{=}CH_2$$

$$CH_2{=}CHSO_2\underset{\underset{SO_2CH{=}CH_2}{|}}{C}HCH_2SO_2CH{=}CH_2$$

$$CH_2{=}CHSO_2CH_2\underset{\underset{SO_2CH{=}CH_2}{|}}{C}HCH_2SO_2CH{=}CH_2$$

-continued

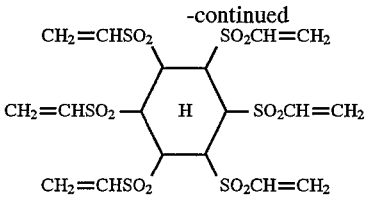

To be effective in inhibiting homopolymerization of the vinyl sulfone hardener, the citric stabilizer is associated with the hardener while all or a portion of the hardener remains in its unreacted monomeric form. The citric stabilizer and the hardener can be brought together in any convenient manner. For example, the citric stabilizer can be blended with the hydrophilic colloid to be hardened so that upon addition of the hardener the citric stabilizer is already present. It is generally preferred that the citric stabilizer be blended with the hardener before the hardener is blended with the hydrophilic colloid.

The vinyl sulfone hardeners described herein can be used in any effective amount in hardening hydrophilic colloids. Suitable amounts are typically in the range of from about 0.5 to about 10 percent by weight, based on the weight of hydrophilic colloid, and more preferably in the amount of from about 1 to about 3 percent by weight.

The citric stabilizer can be used as a homopolymerization inhibitor over a wide range of concentrations. Suitable concentrations of the citric stabilizer are typically in the range of from about 0.01 to about 3 moles per mole of vinyl sulfone hardening agent, more preferably in the range of from about 0.05 to about 1 moles per mole of vinyl sulfone hardening agent, and most preferably in the range of from about 0.1 to about 0.5 moles per mole of vinyl sulfone hardening agent. The time required for polymer to form in the hardening composition increases with increase in the molar ratio of citric stabilizer to vinyl sulfone.

As hereinabove described, it is advantageous to utilize a sulfate as a conductivity marker in conjunction with the use of the citric stabilizer. The use of the sulfate as a conductivity marker is for the purpose of facilitating identification of the hardening solution. Electrical conductivity is much easier to monitor than other characteristics of such solutions and by using the sulfate in an appropriate concentration, a desired level of electrical conductivity can be readily established. Suitable concentrations of the sulfate are typically in the range of from about 0.05 to about 0.6 moles per mole of vinyl sulfone hardening agent, and more preferably in the range of from about 0.1 to about 0.4 moles per mole of vinyl sulfone hardening agent.

Vinyl sulfones are usually prepared from the corresponding haloethylsulfonyl compounds by dehydrohalogenation using a strong organic base such as triethylamine. One of the problems involved in synthesizing such compounds, particularly the more active ones, such as BVSM, is that they tend to homopolymerize in the presence of the strong base. This problem can be alleviated by combining the citric stabilizer with the haloethylsulfonyl precursor compound. In this way, the citric stabilizer is associated with the vinyl sulfone hardener from its inception.

An important feature of the present invention is the ability of the citric stabilizer to protect against homopolymerization in the presence of trace amounts of ferric ion, e.g., 2 to 20 ppm. It is extremely difficult to avoid such levels of iron in production equipment and the invention makes it unnecessary to take special precautions to reduce iron levels. It is believed that the citric stabilizer may interact with ferric ion and effectively "remove" it from the solution and thereby help to inhibit or delay homopolymerization of the vinyl sulfone.

Vinyl sulfones are believed to be able to undergo homopolymerization through a number of different mechanisms, e.g., radical ion (ether cationic or anionic) as well as base-catalyzed polymerization, with the tendency for homopolymerization to occur being in part dependent on the synthesis procedure. The polymer formed can be of high molecular weight and can also be highly crosslinked. In vinyl sulfone hardening solutions which are particularly prone to undergo homopolymerization, a heavy precipitate will settle out quite quickly, for example within a few hours. The extent of precipitation is affected by a number of factors such as, for example, the pH of the composition.

It should be noted that the sulfate can interact with ferric ion to form a yellow-colored precipitate composed, at least in part, of $Fe_3O_4$ and FeO(OH). However, the amount of such precipitate which is formed is slight and it does not present problems of plugging of delivery lines and other equipment to anywhere near the extent that can result from the homopolymerization of the vinyl sulfone hardener. The formation of such precipitates does not appear to occur to the same extent as a result of interaction of the citric stabilizer with ferric ion. This is an advantage favoring the use of the citric stabilizer over the use of sulfates.

The invention is further illustrated by the following examples of its practice. In these examples, the solutions were inspected for polymer formation after specified periods of storage. Upon inspection, if the solution was clear, i.e., no observable precipitate, it was rated "CL." The presence of haze was rated "H" while a solution that was cloudy but with no precipitate was rated "C." The presence of polymeric precipitate was rated "PPT."

EXAMPLE 1

An aqueous solution of BVSME was prepared, maintained at room temperature and inspected for polymer formation after periods of storage ranging from one hour to three months. The solution consisted of 0.0088 moles of BVSME in 100 milliliters of water (2% by weight BVSME). This solution is referred to herein as Control Solution 1. A second solution, referred to as Control Solution 2, was prepared in which the only difference was the addition of ferric ion at a concentration of 20 ppm. A third solution, referred to as Example 1, was the same as Control Solution 2 except that 0.0022 moles of citric acid was added. The results obtained are summarized in Table 1 below.

TABLE I

| Example | $Fe^{+3}$ Concentration (ppm) | Stabilizer | Time: 1 hour | 4 hours | 1 day | 4 days | 6 days | 3 weeks | 3 months |
|---|---|---|---|---|---|---|---|---|---|
| Control 1 | 0 | None | CL | CL | CL | CL | CL | CL | CL |
| Control 2 | 20 | None | PPT | PPT | PPT | PPT | PPT | PPT | PPT |
| Example 1 | 20 | Citric Acid | CL | CL | CL | CL | CL | CL | CL |

As shown by the data in Table 1, no precipitation of polymer occurred in Control Solution 1 which was free of ferric ion. The presence of ferric ion at a concentration of 20 ppm in Control Solution 2 caused rapid precipitation of polymer in that precipitate was observed after only one hour of storage. With the addition of citric acid in Example 1, there was no precipitation even after three months of storage. This was the case even though a high concentration of 20 ppm of ferric ion was employed in Example 1. These results demonstrate the effectiveness of citric acid in preventing homopolymerization of BVSME in the presence of ferric ion.

EXAMPLE 2

In order to determine the effect of concentration of citric acid, Example 1 was repeated at varying levels of citric acid content as summarized in Table 2 below. In each case, ferric ion was present at 20 ppm.

TABLE 2

| Citric Acid Concentration | | Time | | | | | |
|---|---|---|---|---|---|---|---|
| | | 30 | 1 | 2 | 24 | 72 | 22 |
| Moles | PPM | Minutes | hour | hours | hours | hours | days |
| 0.0022 | 4200 | CL | CL | CL | CL | CL | CL |
| 0.0011 | 2100 | CL | CL | CL | CL | CL | CL |
| 0.0005 | 1000 | CL | CL | CL | CL | CL | CL |
| 0.00025 | 500 | CL | CL | CL | CL | CL | CL |
| 0.00012 | 250 | CL | CL | CL | CL | CL | CL |
| 0.000026 | 50 | CL | CL | CL | PPT | PPT | PPT |
| 0.000005 | 10 | PPT | PPT | PPT | PPT | PPT | PPT |

As indicated by the data in Table 2, citric acid in amounts of 250 parts per million or more protected against precipitate formation for the entire 22-day duration of the test. With an amount of 50 parts per million, precipitate formed after 24 hours. An amount of 10 parts per million was insufficient to provide protection against precipitate formation.

EXAMPLE 3

In this example, citric acid was employed in combination with sodium sulfate. The concentration of ferric ion was 20 ppm, the same as in Examples 1 and 2. The levels of citric acid and sodium sulfate employed are summarized in Table 3 below.

TABLE 3

| $Na_2SO_4$ Concentration | Citric Acid Concentration | Time | | | | | |
|---|---|---|---|---|---|---|---|
| (moles) | (moles) | 45 minutes | 90 minutes | 150 minutes | 4 hours | 24 hours | 3 weeks |
| 0.0017 | 0.00013 | CL | CL | CL | CL | CL | CL |
| 0.0017 | 0.000026 | CL | CL | CL | CL | PPT | PPT |
| 0.0017 | 0.000010 | PPT | PPT | PPT | PPT | PPT | PPT |
| 0.0017 | 0.000005 | PPT | PPT | PPT | PPT | PPT | PPT |

As indicated by the data in Table 3, sodium sulfate can be used as a conductivity marker in the presence of citric acid as a polymerization retardant.

EXAMPLE 4

Example 1 was repeated except that 0.0022 moles of the trisodium salt of citric acid was used in place of the 0.0022 moles of citric acid employed in Example 1. The results were the same as in Example 1, i.e., there was no precipitation after three months of storage.

EXAMPLE 5

In this example, a 2% by weight solution of BVSM was used in place of the 2% by weight solution of BVSME employed in Example 1. The ferric ion concentration was 20 ppm. Citric acid, sodium sulfate or combinations of citric acid and sodium sulfate were employed as the stabilizer. The results obtained are summarized in Table 4.

TABLE 4

| $Na_2SO_4$ Concentration (moles) | Citric Acid Concentration (moles) | Time 1 hour | 2 hours | 4 hours | 24 hours | 48 hours | 12 days |
|---|---|---|---|---|---|---|---|
| 0.00085 | 0 | H | C | C | PPT | PPT | PPT |
| 0.0017 | 0 | H | H | H | H | H | H |
| 0.0017 | 0.00013 | CL | CL | CL | CL | CL | CL |
| 0.0017 | 0.000026 | CL | CL | CL | CL | H | H |
| 0.0017 | 0.000010 | CL | CL | CL | H | H | H |
| 0.0017 | 0.000005 | CL | CL | CL | PPT | PPT | PPT |
| 0 | 0.00013 | CL | CL | CL | CL | CL | NR* |
| 0 | 0.000026 | CL | CL | CL | CL | CL | NR |
| 0 | 0.000010 | CL | CL | CL | PPT | PPT | NR |
| 0 | 0.000005 | CL | CL | CL | PPT | PPT | NR |

NR* = Not rated.

As indicated by the data in Table 4, citric acid is an effective stabilizer for use with BVSM and combinations of citric acid and sodium sulfate are effective to serve as both a stabilizer and conductivity marker.

The insoluble and intractable polymers formed as a result of homopolymerization of vinyl sulfone hardener solutions in manufacturing delivery lines are known to induce liquid flow disruptions or flow discontinuities during the coating of photographic products. The flow disruption arises due to partial occlusion of the delivery lines (control valves, strainers and/or pumps), while the flow discontinuities are caused by total occlusion of the delivery lines or delivery line components. This has been a major problem which has long plagued the photographic manufacturing process and solutions to the problem proposed heretofore have been generally ineffective. Thus, for example, while the nitro-substituted aromatic compounds of U.S. Pat. No. 4,171,976 provide effective protection in the synthesis stage of vinyl sulfone manufacture and use they are not as effective as desired in the stages involved in preparation and coating of gelatin or other hydrophilic colloid compositions.

The citric stabilizers have been found to be surprisingly effective as stabilizers which prevent homopolymerization of vinyl sulfone hardeners. By their use, the concentration of vinyl sulfone hardener in solution does not significantly change from the point of manufacture to the point of use. Stringent specifications can thus be maintained for solution concentration. The integrity of the delivery system is not compromised due to plugging by polymer and the burdens of maintenance and cleaning are greatly reduced. The citric stabilizers can be effectively employed in combination with a sulfate which serves as a conductivity marker.

The invention has been described in detail, with particular reference to certain preferred embodiments thereof, but it should be understood that variations and modifications can be effected within the spirit and scope of the invention.

We claim:

1. A hardening composition that is useful in hardening a hydrophilic colloid which is incorporated in a layer of a photographic element, said hardening composition comprising a vinyl sulfone hardening agent and a sufficient amount of a stabilizer to inhibit homopolymerization of said vinyl sulfone hardening agent, said stabilizer being selected from the group consisting of citric acid, ammonium salts of citric acid, alkali metal salts of citric acid and alkaline earth metal salts of citric acid.

2. A hardening composition as claimed in claim 1, wherein said vinyl sulfone hardening agent is represented by the formula:

$$(H_2C{=}CH{-}SO_2)_n{-}Z$$

wherein n is an integer with a value of 2 to 6 and Z is an organic linking group with a valence equal to n.

3. A hardening composition as claimed in claim 2, wherein Z is a heteroatom or an alkyl, alkylene, aryl, arylene, aralkyl or alkaryl group.

4. A hardening composition as claimed in claim 1, wherein said vinyl sulfone hardening agent is represented by the formula:

$$CH_2{=}CH{-}SO_2{-}(CH_2)_x{-}SO_2{-}CH{=}CH_2$$

wherein x is an integer with a value of from 1 to 3.

5. A hardening composition as claimed in claim 1, wherein said vinyl sulfone hardening agent is bis (vinylsulfonyl)methane.

6. A hardening composition as claimed in claim 1, wherein said vinyl sulfone hardening agent is bis (vinylsulfonylmethyl)ether.

7. A hardening composition as claimed in claim 1, wherein said stabilizer is citric acid.

8. A hardening composition as claimed in claim 1, wherein said stabilizer is an alkali metal salt of citric acid.

9. A hardening composition as claimed in claim 1, wherein said stabilizer comprises a trisodium salt of citric acid.

10. A hardening composition as claimed in claim 1, wherein said stabilizer is present therein in an amount of from about 0.05 to about 1 mole per mole of vinyl sulfone hardening agent.

11. A hardening composition as claimed in claim 1, wherein said stabilizer is present therein in an amount of from about 0.1 to about 0.5 mole per mole of vinyl sulfone hardening agent.

12. A hardening composition as claimed in claim 1, additionally containing a sufficient amount of ammonium sulfate, an alkali metal sulfate or an alkaline earth metal sulfate to act as a conductivity marker.

13. An aqueous coating composition that is useful in the preparation of a photographic element; said coating composition comprising a hydrophilic colloid, a sufficient amount of a vinyl sulfone hardening agent to harden said hydrophilic colloid, and a sufficient amount of a stabilizer to inhibit homopolymerization of said vinyl sulfone hardening agent, said stabilizer being selected from the group consisting of citric acid, ammonium salts of citric acid, alkali metal salts of citric acid, and alkaline earth metal salts of citric acid.

14. An aqueous coating composition as claimed in claim 13, wherein said hydrophilic colloid is gelatin.

15. An aqueous coating composition as claimed in claim 13, wherein said vinyl sulfone hardening agent is present therein in an amount of fr6m about 0.5 to about 10 percent by weight based on the weight of said hydrophilic colloid and said stabilizer is present therein in an amount of from about 0.05 to about 1 mole per mole of vinyl sulfone hardening agent.

16. An aqueous coating composition as claimed in claim 13, wherein said vinyl sulfone hardening agent is bis (vinylsulfonylmethyl)ether and said stabilizer comprises a trisodium salt of citric acid.

17. In a process of hardening an aqueous coating composition that is useful in forming a layer of a photographic element comprising the step of adding a vinyl sulfone hardening agent to a hydrophilic colloid, the improvement comprising inhibiting homopolymerization of said vinyl sulfone hardening agent with an inhibitor selected from the group consisting of citric acid, ammonium salts of citric acid, alkali metal salts of citric acid and alkaline earth metal salts of citric acid.

18. A process as claimed in claim 17, wherein said hydrophilic colloid is gelatin, said vinyl sulfone hardening agent is bis(vinylsulfonylmethyl)ether and the inhibitor comprises a trisodium salt of citric acid.

19. In a process for the manufacture of a photographic element comprising the step of adding a vinyl sulfone hardening agent to a coating composition containing a hydrophilic colloid and coating said composition on a photographic support, the improvement comprising inhibiting homopolymerization of said vinyl sulfone hardening agent with an inhibitor selected from the group consisting of citric acid, ammonium salts of citric acid, alkali metal salts of citric acid and alkaline earth metal salts of citric acid.

20. A process as claimed in claim 19, wherein said hydrophilic colloid is gelatin, the inhibitor comprises a trisodium salt of citric acid.

21. In a photographic element comprising a support having one or more layers coated thereon at least one of which is radiation-sensitive and at least one of which contains a hydrophilic colloid at least partially forehardened with a vinyl sulfone hardening agent, the improvement wherein said at least one layer containing said vinyl sulfone hardening agent also contains a stabilizer in an amount sufficient to inhibit homopolymerization of said vinyl sulfone hardening agent, said stabilizer being selected from the group consisting of citric acid, ammonium salts of citric acid, alkali metal salts of citric acid and alkaline earth metal salts of citric acid.

22. A photographic element as claimed in claim 21, wherein said hydrophilic colloid is gelatin, said vinyl sulfone hardening agent is bis(vinylsulfonylmethyl)ether and said stabilizer comprises a trisodium salt of citric acid.

* * * * *